US005818483A

United States Patent [19]

Mizutani

[11] Patent Number: 5,818,483

[45] Date of Patent: Oct. 6, 1998

[54] ACTUATOR BODY STRUCTURE FOR A PIEZOELECTRIC INK EJECTING PRINTING APPARATUS

[75] Inventor: Tsuyoshi Mizutani, Nagoya, Japan

[73] Assignee: Brother Kogyo Kabushiki Kaisha, Nagoya, Japan

[21] Appl. No.: 530,423

[22] Filed: Sep. 19, 1995

[30] Foreign Application Priority Data

Jan. 19, 1995 [JP] Japan ..... 7-006439

[51] Int. Cl.[6] ..... B41J 2/045

[52] U.S. Cl. ..... 347/72; 347/71

[58] Field of Search ..... 347/71, 72

[56] References Cited

U.S. PATENT DOCUMENTS

| | | | |
|---|---|---|---|
| 4,879,568 | 11/1989 | Bartky et al. . | |
| 5,444,471 | 8/1995 | Usui et al. | 347/72 |
| 5,446,485 | 8/1995 | Usui et al. | 347/72 |
| 5,646,661 | 7/1997 | Asai et al. | 347/69 |

FOREIGN PATENT DOCUMENTS 3-272856 12/1991 Japan .

*Primary Examiner*—Daniel P. Malley
*Attorney, Agent, or Firm*—Oliff & Berridge, PLC

[57] ABSTRACT

An ink ejecting print head includes an actuator having a plurality of grooves, and a plurality of partition walls separating the grooves. One conductor layer is provided at the center of each partition wall. Other conductor layers connect to conductive thin films provided in each of the ink channels. A voltage is applied to a driving electrode which is electrically connected to conductive thin film provided in one ink channel. The driving electrodes connected to the conductive thin films in the other ink channels and to the conductor layers in the partition walls are grounded. At this time, an electric field occurs in an area of an ink-channel side of each partition wall defining the ink channel, and each adjacent side of the partition wall is deformed. Therefore, the volume of the ink channel is decreased to produce pressure, so that ink is ejected from a nozzle intercommunicating with the ink channel. At this time, no electric field occurs in an area of the partition wall which is at the opposite side to the ink-channel side, so that the other ink channels adjacent to the ink channel are not affected by the deformation of the ink channel.

19 Claims, 13 Drawing Sheets

ACTUATOR BODY STRUCTURE FOR A PIEZOELECTRIC INK EJECTING PRINTING APPARATUS

BACKGROUND OF THE INVENTION

1. Field of the Invention

This invention relates to an ink ejecting printing apparatus having a plurality of nozzles, a plurality of ink channels connected to the plurality of nozzles, and a plurality of partition walls, each partition wall partitioning adjacent ink channels and formed of piezoelectric ceramic material. In particular, this invention relates to electrodes provided in a center of each partition wall, and electrodes provided within each ink channel, so that an electric field can be provided separately in one half of a partition wall without generating an electric field in the other half of the partition, such that only one-half of the partition wall is deformed.

2. Description of the Related Art

Non-impact type printing devices have recently replaced conventional impact type printing devices and have become very popular. Of these non-impact type printing devices, the ink-ejecting type printing devices are known to operate on the simplest principles and can be effectively used to easily generate multi-level and color images. Of these ink-ejecting type printing devices, a drop-on-demand type printing device for ejecting ink droplets only when an image dot is needed has rapidly become popular because of its excellent ejection efficiency and low running cost.

A conventional ink ejecting print head of an ink-ejecting type printing device, as disclosed in Japanese Laid-open Patent Application No. 3-272856, is shown in FIGS. 12–14B. FIG. 12 is an exploded view showing the conventional ink ejecting print head. FIG. 13 is a perspective view showing the ink ejecting printing head of FIG. 12. FIGS. 14A and 14B are diagrams showing the operation of the conventional ink ejecting print head of FIGS. 12 and 13.

In FIG. 12, a plurality of piezoelectric actuators 22 are secured onto a substrate 21. The grooves which are defined by the piezoelectric actuators 22 on the substrate 21 are designed to have the same width, by inserting one of a plurality of spacers 23 between each pair of adjacent actuators 22. That is, the piezoelectric actuators 22 are arranged at fixed intervals. A cover plate 24 is secured onto the piezoelectric actuators 22 and the spacers 23 to form a plurality of ink channels 28. A nozzle plate 25 is secured to the front faces of the substrate 21, the piezoelectric actuators 22 and the cover plate 24 to form the ink ejecting print head shown in FIG. 13. A plurality of nozzles 29 are formed in the nozzle plate 25, each nozzle 29 connecting with one of the plurality of channels 28.

Each piezoelectric actuator 22 comprises a plurality of alternating piezoelectric ceramic green sheets and conductive layers which are laminated on each other. A signal electrode 20A for applying a voltage is formed on one of the outer surfaces of each piezoelectric actuator 22, and a ground electrode 20B which is grounded is formed on the other outer surface of each piezoelectric actuator 22.

Ink supplied from an ink supply port 26 formed in the cover plate 24 is stored both in a manifold 27, which is provided inside the cover plate 24, and in each ink channel 28 formed between adjacent piezoelectric actuators 22. Upon actuation of a pair of adjacent piezoelectric actuators 22, the ink stored in the ink channel 28 sandwiched between the pair of actuated actuators 22 is ejected from the nozzle 29.

As shown in FIGS. 12 and 14A, the substrate 21, the cover plate 24 and the piezoelectric actuators 22A and 22B form the walls of the ink channel 28A. When a driving voltage required to eject ink from the ink channel 28A is applied to the piezoelectric actuators 22A and 22B, the piezoelectric actuators 22A and 22B expanded as indicated by the broken lines in FIGS. 14A and 14B. Thus, the volume of the ink channel 28A decreases, so that the ink in the ink channel 28A is ejected from the corresponding nozzle 29A.

At this time, the volume of the ink channels 28B and 28C, which are adjacent to the ink channel 28A, also decreases due to the actuation of the piezoelectric actuators 22A and 22B. However, no ink in the ink channels 28B and 28C is ejected through the corresponding nozzles 29B and 29C because only one of the pair of piezoelectric actuators 22C and 22A, and 22B and 22D, respectively, forming the side walls of the ink channels 28B and 28C is actuated.

However, in the ink ejecting print head described above, when the ink is ejected from the ink channels 28A and 28D at the same time, the piezoelectric actuators 22A and 22C forming both of the side walls of the ink channel 28B, through which ink should not be ejected, are deformed, so that ink is unintentionally ejected from the ink channel 28B.

Therefore, the plurality of ink channels 28 must be divided into three groups of ink channels, with two ink channels of the other groups between each pair of adjacent ink chambers in each group. That is, ink channels 28C and 28D are in the same group, while the ink channel 28A and the ink channel 28B are in different groups from each other and from the ink channels 28C and 28D. A time lag must also be provided in the ink ejection timing between each of the groups.

However, even when a time lag is provided in the ink ejection timing between the different groups of ink channels, when the piezoelectric actuators 22A and 22B are actuated to decrease the volume of the ink channel 28A, the volume of the ink channels 28B and 28C, which are adjacent to the ink channel 28A, are simultaneously decreased as the piezoelectric actuators 22A and 22B are deformed. Therefore, the pressure of the ink stored in the ink channels 28B and 28C increases. When ink is required to be ejected from the ink channels 28B and 28C, the amount and flight speed of ink droplets from the ink channels 28B and 28C may vary due to the ink in the ink channels 28B and 28C being pressurized (or not) just before the ink is ejected from these channels 28B and 28C. The variation in the amount and the flight speed of the ink droplets from the ink channels 28B causes deterioration in the quality of the formed image.

In order to eject ink without affecting the adjacent ink channels, a dummy (i.e., empty) channel can be provided between adjacent ink channels, as in the ink ejecting printing apparatus disclosed in U.S. Pat. No. 4,879,568. However, this construction necessarily increases the nozzle pitch. Thus, it is difficult to design the nozzle array having a sufficiently high density. In addition, when the ink ejection timing is delayed until the increased pressure generated in the ink channels 28B and 28C is reduced, the print speed is undesirably reduced.

SUMMARY OF THE INVENTION

This invention therefore provides an ink ejecting printing apparatus which is capable of performing a high-speed printing operation using a high-density array of nozzles. To accomplish this, the ink ejecting printing apparatus of this invention includes a plurality of nozzles, a plurality of ink channels, each ink channel connecting to a corresponding one of the nozzles, a plurality of partition walls, each partition wall partitioning adjacent ink channels from each other, wherein at least a portion of each partition wall is formed of piezoelectric ceramic material, first electrodes formed on an outer surface of each partition wall, the outer surface of each first electrode forming an inner surface of the corresponding ink channel, second electrodes formed inside each partition wall substantially in parallel to the first electrodes, and control means for generating an electric field between a first electrode and the second electrodes of the adjacent partition walls for an ink channel through which ink is to be ejected, i.e., an ejection ink channel, while avoiding the generation of any electric field between another first electrode and the second electrodes of the adjacent partition walls for an ink channel through which no ink is to be ejected, i.e., a non-ejection ink channel.

According to the ink ejecting printing apparatus of this invention, the control means generates an electric field between the first electrode in the ejection ink channel and the second electrodes in the adjacent partition walls, and does not generate an electric field between the first electrodes in adjacent non-ejection ink channels and the second electrodes in the shared partition walls. With this control operation, only one side of a shared partition wall, corresponding to the ejection ink channel, is deformed. Thus, the volume of only the ejection ink channel is decreased, so that the ink is ejected from the ejection ink channel without effecting the adjacent non-ejection ink channel. At this time, since the other side of the shared partition wall, corresponding to the adjacent non-ejection ink channel, is not deformed, the volume of the adjacent non-ejection ink channel does not decrease.

As set forth above, according to the ink ejecting printing head of this invention, one first electrode is provided on each of the outer surfaces of a shared partition wall, the partition wall serving as the inner surface of two adjacent ink channels. The second electrode is provided in the shared partition wall substantially in parallel to the first electrodes. The control means generates an electric field between one first electrode, corresponding to the ejection ink channel, and the second electrode of the shared partition wall, but generates no electric field between the other first electrode, corresponding to the non-ejection ink channel, and the second electrode. Therefore, only one side of the shared partition wall, corresponding to the ejection ink channel, is deformed, and the volume of the ejection ink channel decreases to eject an ink drop. On the other hand, the other side of the shared partition wall, corresponding to the non-ejection ink channel, is not deformed. Thus, the volume of the non-ejection ink channel does not decrease.

As described above, the non-ejection ink channel which is adjacent to the ejection ink channel suffers no effect, so that no dummy channel is required between the ink channels. Accordingly, the integration degree, or density, of the nozzles can be improved. In addition, since ink can be ejected from the adjacent ink channels at the same time, high-speed printing can be performed.

These and other features and advantages of the invention are described in or apparent from the following detailed description of the preferred embodiments.

BRIEF DESCRIPTION OF THE DRAWINGS

The preferred embodiments of this invention will be described in detail, with reference to the following figures, wherein.

DETAILED DESCRIPTION OF THE PREFERRED EMBODIMENTS

Figure 1:
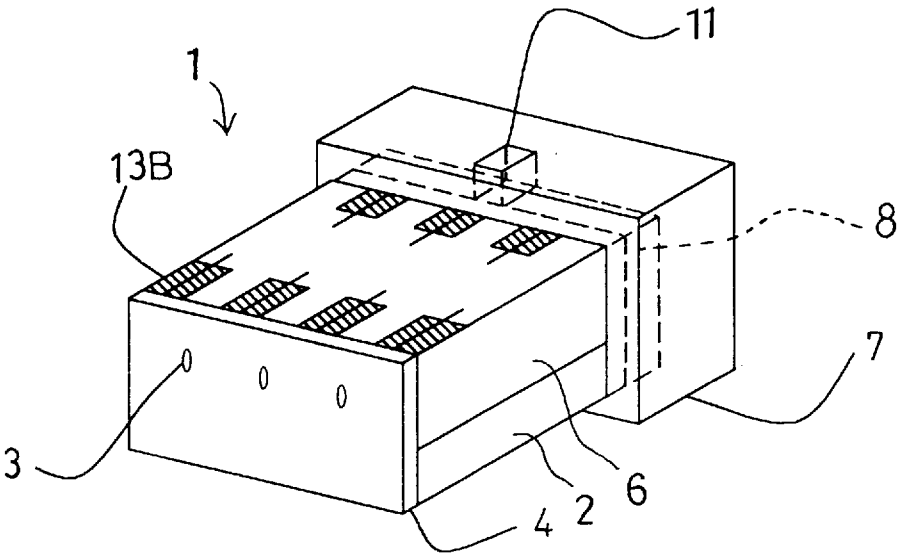
FIG. 1 is a perspective view of a first preferred embodiment of the ink ejecting print head of this invention.
Figure 2:
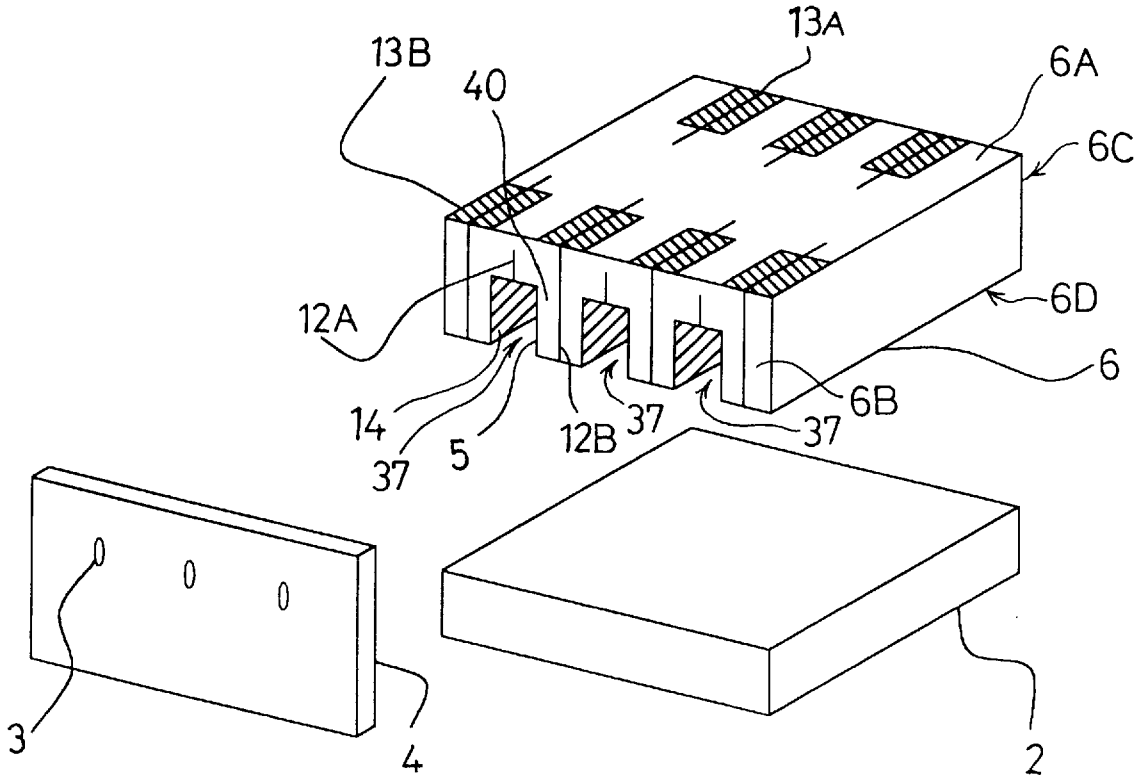
FIG. 2 is an exploded perspective view of the first preferred embodiment of the ink ejecting print head of this invention.

As shown in FIG. 1, the first preferred embodiment of the ink ejecting print head 1 comprises an actuator body 6, a cover plate 2, a nozzle plate 4 and a manifold 7. A plurality of nozzles 3 are formed in the nozzle plate 4. Each nozzle 3 connects to a corresponding one of a plurality of ink channels 37, as shown in FIG. 2, formed in the actuator body 6. Ink is supplied to an ink supply port 11 of the manifold 7. The ink is then supplied to the plurality of ink channels 37 through an ink pool 8 of the manifold 7. Upon application of a driving voltage required for ejecting ink to a driving electrode 13, a volume of a corresponding ink channel 37 decreases to eject a drop of ink from a corresponding nozzle 3.

FIG. 2 is an exploded perspective view of the ink ejecting print head 1 shown in FIG. 1. As shown in FIG. 2, the actuator body 6 is secured onto the cover plate 2, which is formed of ceramic material. The actuator body 6 is formed of a laminated piezoelectric element 35. A plurality of grooves 5 and a plurality of partition walls 40 partitioning the respective grooves 5 are formed in the actuator body 6. The laminated piezoelectric element 35 is obtained by alternately laminating a plurality of piezoelectric members 30 and a plurality of conductor layers 12A and 12B onto one another.

The grooves 5 are formed so that they extend along the conductor layers 12A in the bottom surface of the laminated piezoelectric element 30, i.e., at the cover plate 2 side. The plurality of grooves 5 are formed in the laminated piezoelectric element 35 corresponding to every other conductor layer 12A. Accordingly, the corresponding conductor layers 12A are exposed at the bottom surfaces of the grooves 5.

On the top surface 6A of the actuator body 6, i.e., on the surface in which no grooves are formed, at least parts of the conductor layers 12A and 12B are alternately exposed at one end side of the surface. A pair of conductive thin films are formed to contact the exposed conductor layers 12A and 12B. Each of the conductive thin films forms one of a pair of driving electrode 13A and 13B.

Further, another conductive thin film 14 is formed on the inner surface of each groove 5. Each of the conductive thin films 14 is electrically connected to one of the conductive layers 12A which is exposed at the bottom surface of a groove 5. The driving electrodes 13A, which are electrically connected to the conductive thin films 14 formed in the grooves 5, are disposed at the back surface 6C of the actuator body 6, i.e., at the side opposite to the front or nozzle plate surface 6B. The driving electrodes 13B, which are electrically connected to the conductive thin films formed to contact the exposed conductor layers 12B formed in the partition walls 40, are disposed near the front surface 6B of the actuator body 6.

The cover plate 2 is joined to the groove-formed, or bottom, surface 6D of the actuator 6 to cover the grooves 5 and form the ink channels 37. Three such ink channels 37 are shown in FIG. 2. The nozzle plate 4 is fixed to the front surface 6B of the actuator body 6 and the front surface of the cover plate 2. The manifold 7 is fixed to the back surface 6C of the actuator 6 and the back surface of the cover plate 2 to form the ink ejecting print head shown in FIG. 1.

Figure 3:
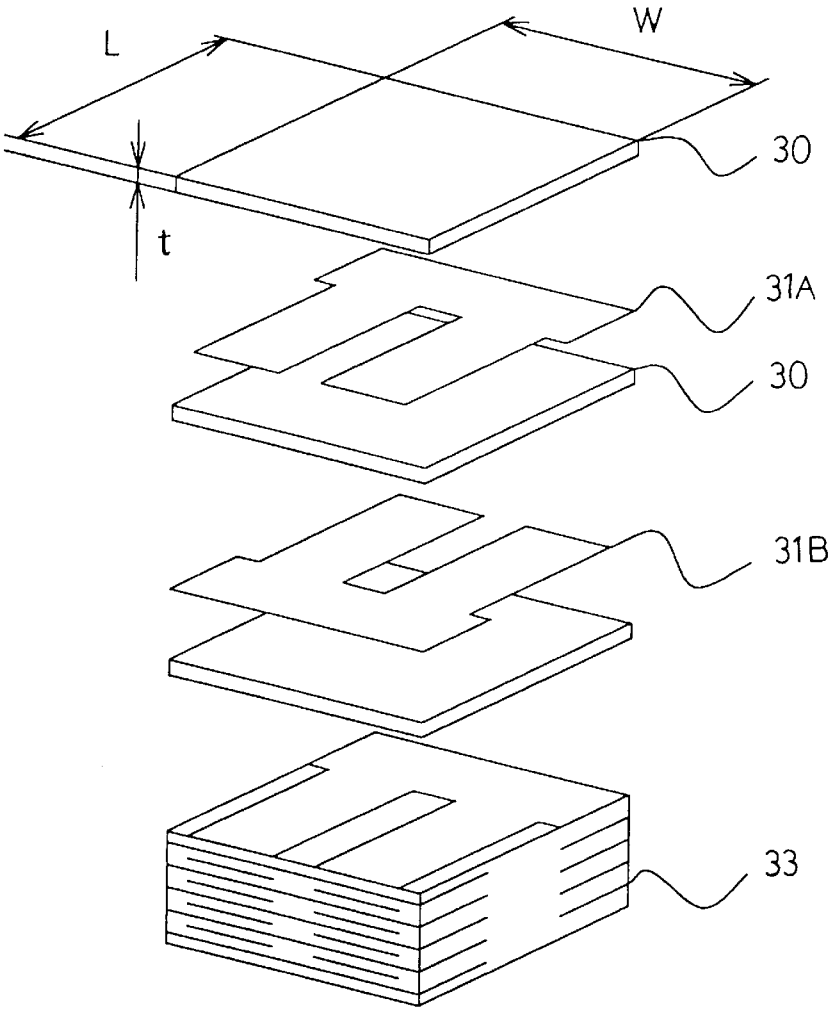
FIG. 3 is a perspective exploded view of a laminate body used in the first preferred embodiment of the ink ejecting print head of this invention.

As shown in FIG. 3, a plurality of piezoelectric material sheets, or green sheets, 30 and conductor layers 31A and 31B are alternately laminated onto one another until the total thickness is equal to the desired width of the actuator body 6, which corresponds to the desired number of ink channels 37. Each green sheet 30 is formed of a piezoelectric ceramic powder, organic binder, plasticizer, and the like and has a thickness t, of, for example, 70 $\mu$m, a length L, and a width W.

Figure 4A:
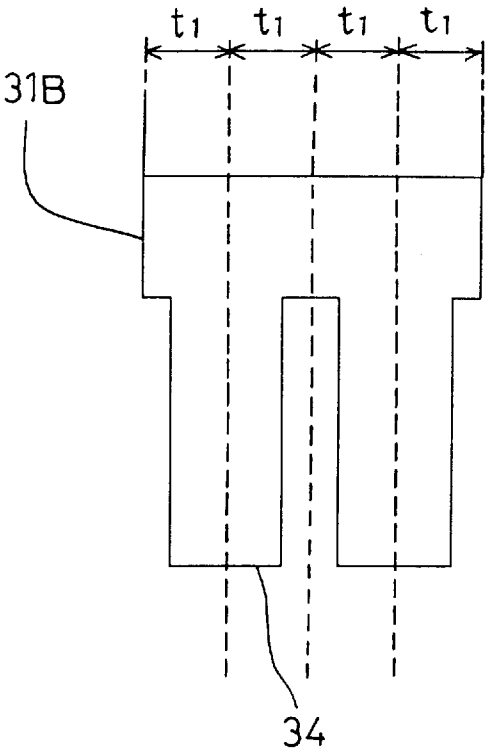
FIG. 4A shows the shape of a first laminate electrode of the first preferred embodiment of the ink ejecting print head of this invention.
Figure 4B:
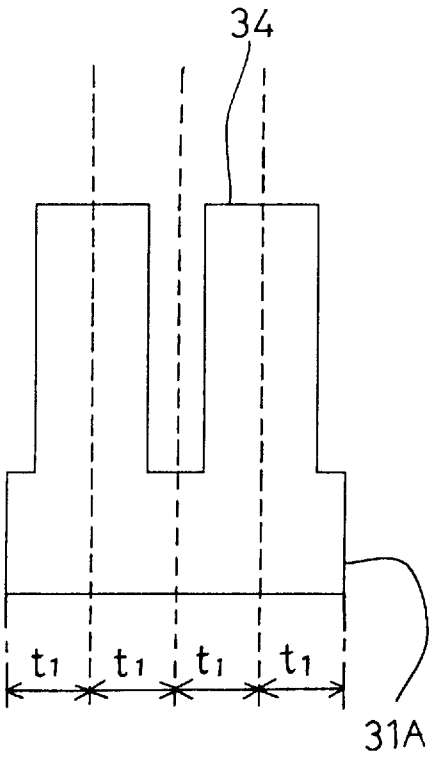
FIG. 4B shows the shape of a second laminate electrode of the first preferred embodiment of the ink ejecting print head of this invention.

Thus, a first conductor layer 31A is laminated on a first green sheet 30, a second green sheet 30 is laminated on the first conductor layer 31A, and then a second conductor layer 31B is laminated on the second green sheet 30. This lamination is subsequently repeated. Lead zirconate titanate (PZT) is preferably used as the piezoelectric ceramic material. Each of the conductor layers 31A and 31B is designed to have a comb shape 34, as shown in FIGS. 4A and 4B. These conductor layers 31A and 31B are alternately laminated onto the green sheets 30 so that the comb-shaped portions of the conductor layers 31A and 31B oppose each other. That is, the teeth portions of the conductor layers 31A and 31B point in opposite directions, as shown in FIGS. 4A and 4B.

Figure 5:
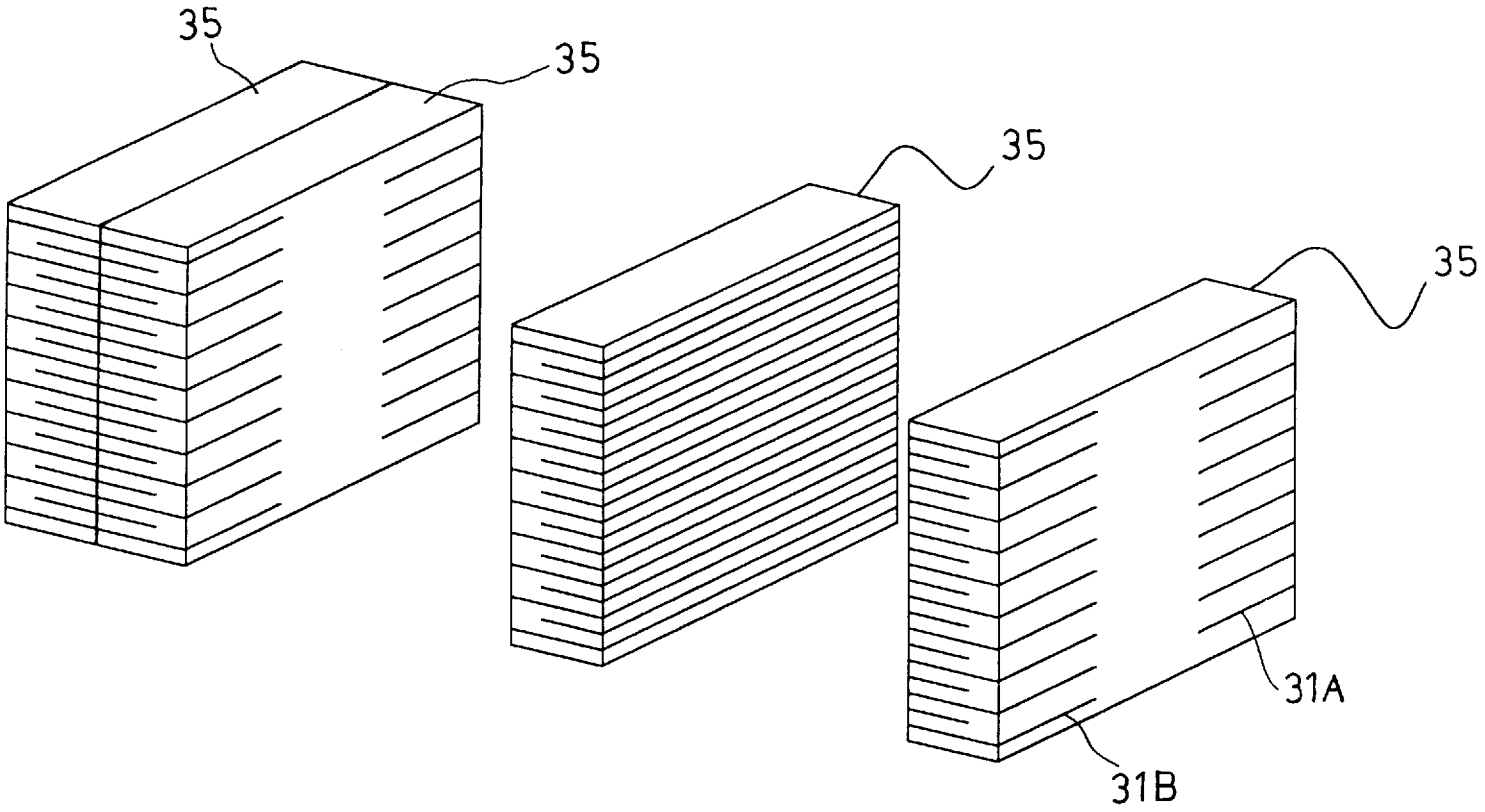
FIG. 5 is a perspective view showing the laminate body cut into two actuators body for the ink ejecting print head of this invention.

A laminate body 33 comprising the green sheets 30 and the conductor layers 31A and 31B is sintered into a single body. As shown in FIG. 5, the sintered laminate body 33 is sliced into four sections in a direction perpendicular to the laminate face at an interval of t1 (3 mm, for example) as indicated by the broken lines of FIGS. 4A and 4B. The sintered laminate body 33 is cut by a cutting device, such as a dicing saw or the like. Accordingly, four plate-shaped laminated piezoelectric elements 35, as shown in FIG. 5, are obtained.

Figure 6A:
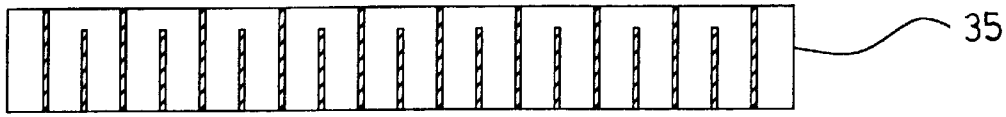
FIGS. 6A to 6D show a series of processes for manufacturing the actuators from an actuator body for the first preferred embodiment of the ink ejecting print head of this invention.

As shown in FIG. 6A, both the conductor layers 31A and 31B are exposed to the lower surface of the laminated piezoelectric elements 35. However, as shown in FIG. 5, only a portion of the conductor layers 31A and 31B are exposed at the upper surface of the laminated piezoelectric element 35. Additionally, only the conductor layer 31A is exposed at one end of the upper surface, and only the conductive layer 31B is exposed at the other end of the upper surface.

Figure 6B:
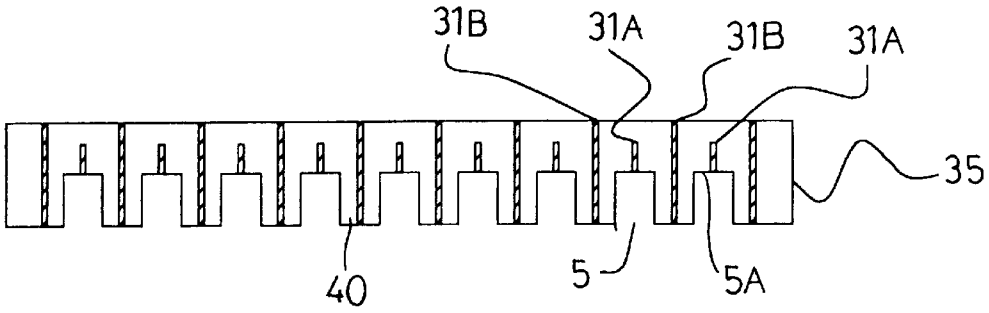
Figure 6C:
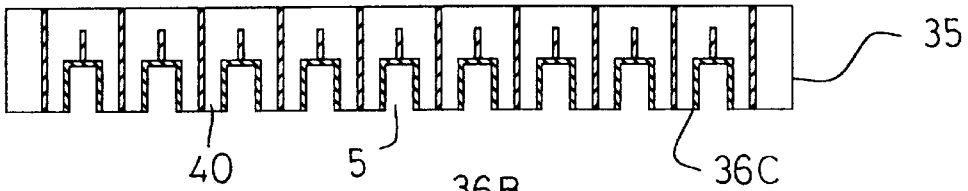

The plurality of grooves 5 are formed along the conductor layers 31A on the lower surface of the laminated piezoelectric element 35, as shown in FIG. 6B, by cutting using a dicing saw or the like. Therefore, one conductor layer 31A is exposed at the bottom surface 5A of each of the grooves 5. The conductor layers 31B are embedded into the partition walls 40 by which the grooves 5 are partitioned. Each of the conductor layers 31B is centered at the middle of the corresponding partition wall 40.

Subsequently, a number of conductor thin films 36A, 36B and 36C are formed on the conductor layers 31A and 31B exposed at the upper surface of the laminate plate 35 and in the grooves 5 by an electrodes plating method or the like. Each conductive thin film 36C is electrically connected through each conductor layer 31A to each conductive thin film 36A. By the above method, the actuator body 6 is formed. The conductor layers 31A and 31B correspond to the conductor layers 12A and 12B, respectively, described above. The conductive thin film 36C corresponds to the conductive thin film 14 described above. The conductive thin films 36A and 36B correspond to the driving electrodes 13A and 13B described above.

Figure 6D:
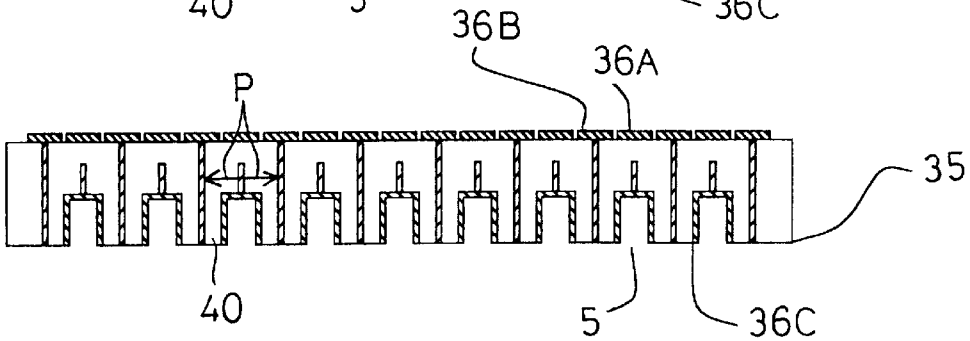

Subsequently, a high-strength electric field is applied across the driving electrodes 13A and 13B to polarize the piezoelectric actuator body 6. In particular, as shown in FIG. 6D, each half of each shared partition wall 40 is polarized in a direction P extending from the adjacent conductor layer 31A to the embedded conductor layer 31B.

As described above, the cover plate 2, the nozzle plate 4 and the manifold member 7 are adhesively attached to the actuator body 6. Thereafter, the electrodes 13 are connected to a wiring pattern of a flexible print board (not shown). The wiring pattern of the flexible print board is connected to a rigid board (not shown) connected to a controller.

Figure 7:
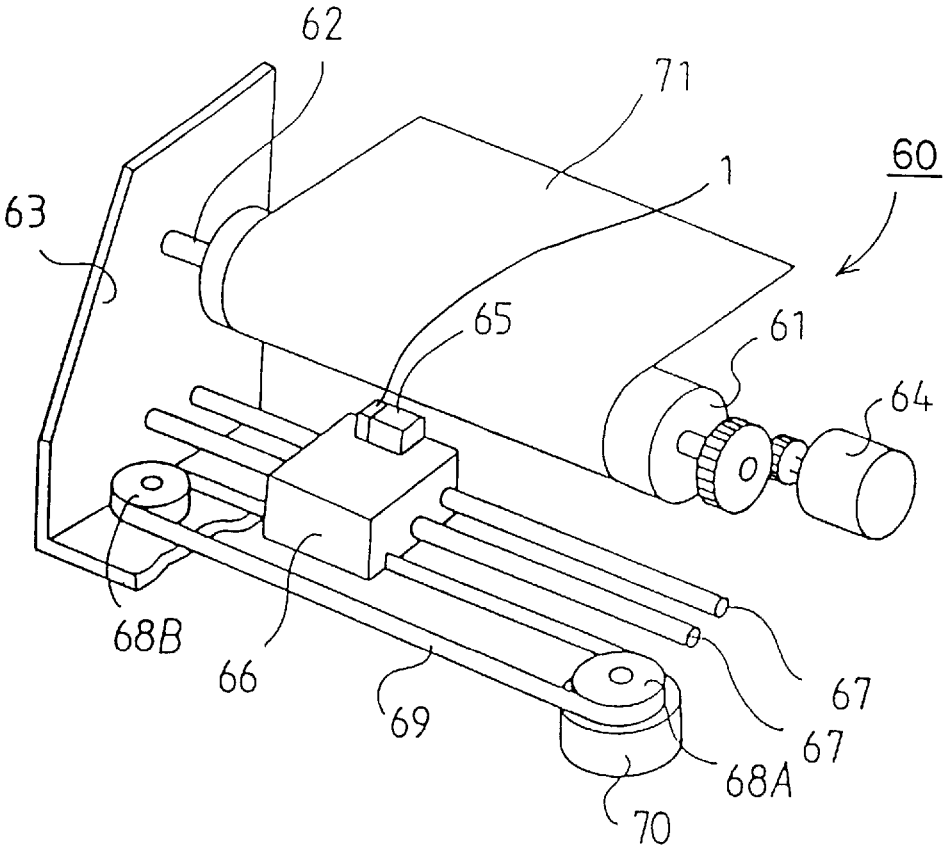
FIG. 7 is a perspective view of a part of the ink ejecting printing apparatus incorporating the first preferred embodiment of the ink ejecting print head of this invention.

FIG. 7 is a perspective view showing the construction of a printer 60 using the ink ejecting print head 1. In the printer 60 shown in FIG. 7, a platen 61 is rotatably mounted to a frame 63 through a shaft 62. The platen 61 is rotatably driven by a platen motor 64. The ink ejecting print head 1 is mounted facing the platen 61 on a carriage 66, together with an ink cartridge 66. The carriage 66 is slidably supported on two guide rods 67, which are positioned in parallel to the axis of the platen 61. The carriage 66 is linked to a timing belt 69, which is wound around a pair of pulleys 68A and 68B. The pulley 68 is connected to a carriage motor 70. When the pulley 68A is rotated by the carriage motor 70 and the timing belt 69 is fed, the carriage 66 moves along the guide rods 67.

Figure 8:
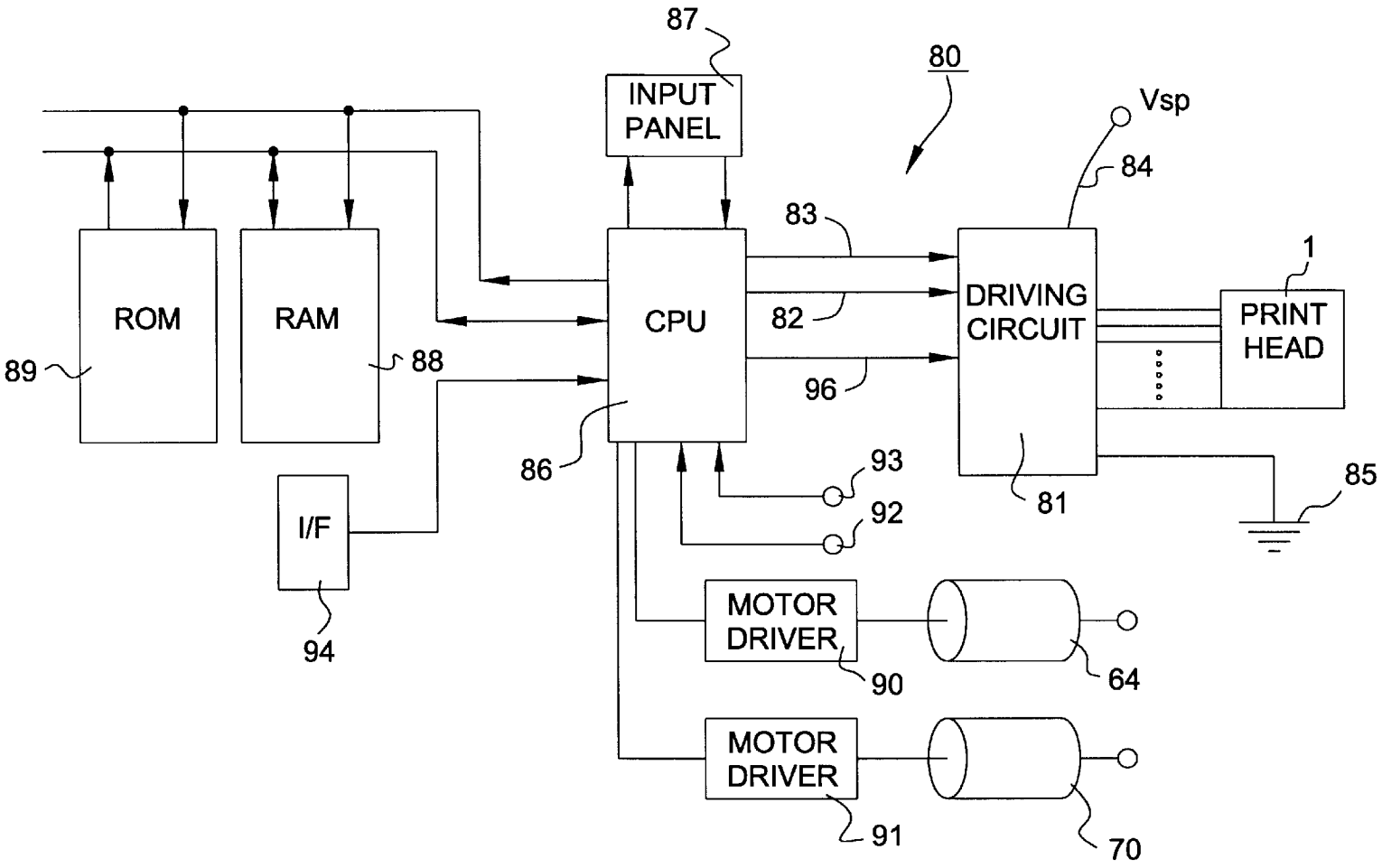
FIG. 8 is a block diagram of a controller for the ink ejecting printing apparatus incorporating the first preferred embodiment of the ink ejecting print head of this invention.

FIG. 8 is a block diagram showing a controller 80 for operating the printer 60 and the ink ejecting print head 1. Each of the electrodes 13 of the actuator 6 of the ink ejecting print head 1 is individually connected to a driving circuit 81 by the wiring patterns. A clock line 82 for transmitting a clock signal, a data line 83 for transmitting input print data synchronously with the clock signal, a fire clock signal line 96 for supplying an ink ejecting timing signal to the ink ejecting print head 1, a voltage line 84 for supplying a voltage and an ground line 85 are also connected to the driving circuit 81. The clock line 82, the print data line 83 and the fire clock signal line 76 connected to the driving circuit 81 are also connected to a microcomputer 86.

The microcomputer 86 is connected to an input panel 87 for inputting a mode switching instruction or the like, an interface 94, a RAM 88 for temporarily storing data input from the input panel 87 and/or the interface 94, a ROM 89 in which print patterns for print characters and the like are stored, motor drivers 90 and 91, a sheet sensor 92 for detecting misregistration of the sheet 71 in a main scanning direction or a sub-scanning direction, and an origin sensor 93 for detecting whether the scanning start position of the ink ejecting print head 1 is at the origin. The motor drivers 90 and 91 are connected, respectively, to the platen motor 64 and the carriage motor 70.

Figure 9:
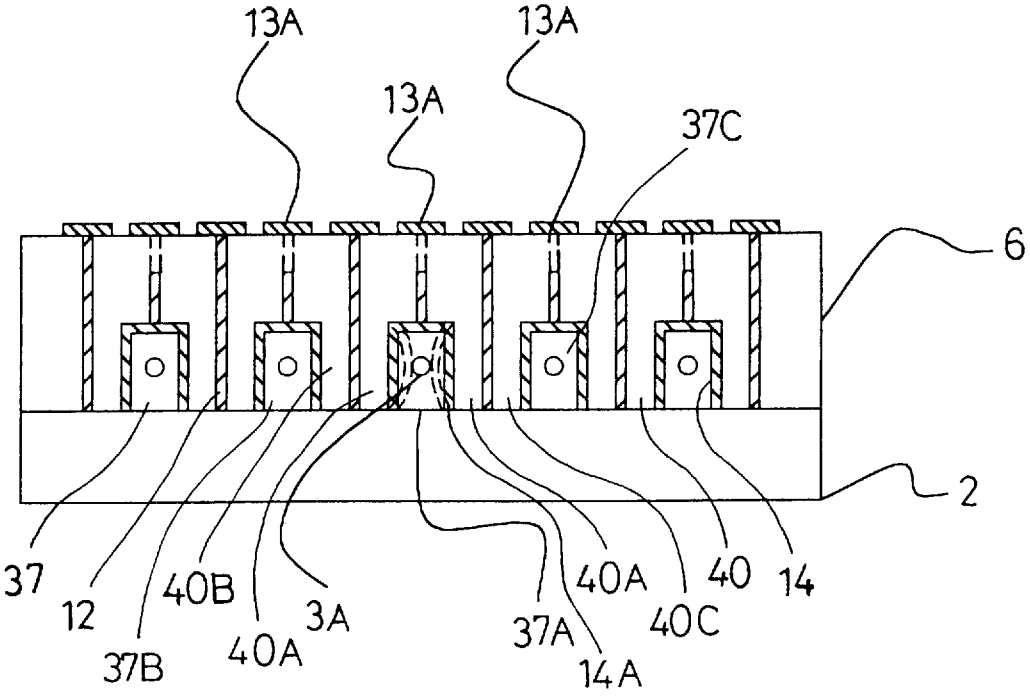
FIG. 9 illustrates the operation of the first preferred embodiment of the ink ejecting print head of this invention.

When the driving circuit 81 determines that ink is to be ejected only from an ink channel 37A, as shown in FIG. 9, the driving circuit 81 applies a voltage to a driving electrode 13A which is electrically connected to the conductive thin film 14A in the ink channel 37A by a conductive layer 12A. The driving circuit also connects the driving electrodes 13A connected to the conductive thin films 14 in the other ink channels 37 and the driving electrodes 13B connected to the conductor layers 12B in the partition walls 40 to ground.

Figure 12:
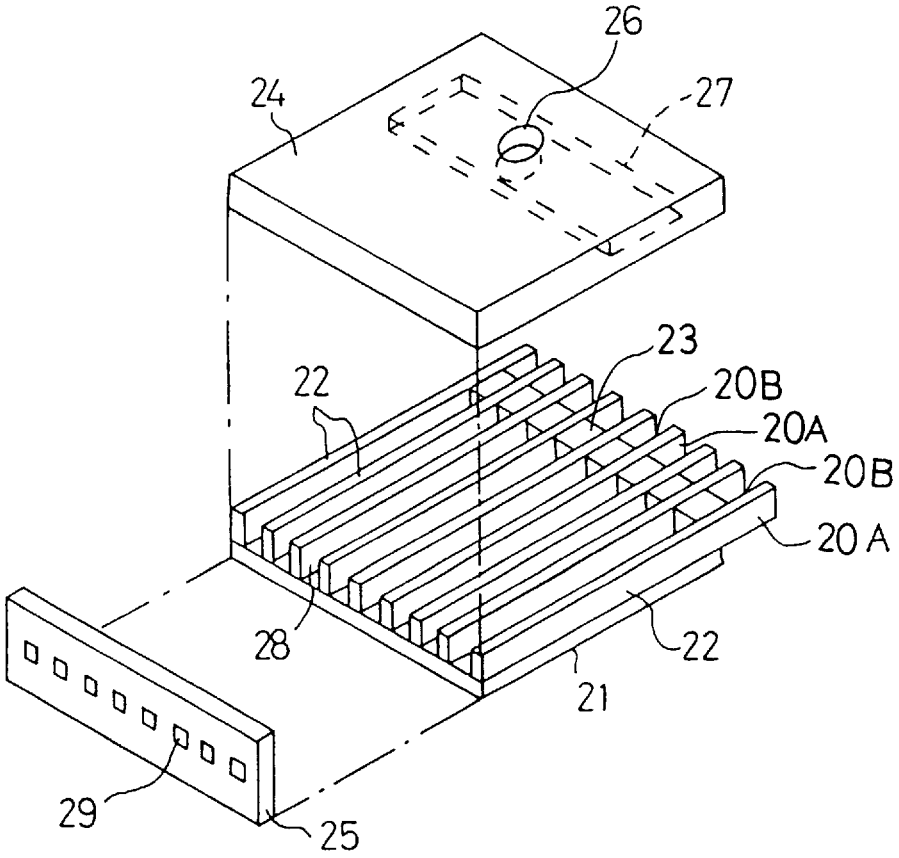
Fig.12 RELATED ART
FIG. 12 is an exploded perspective view of a conventional ink ejecting print head.
Figure 13:
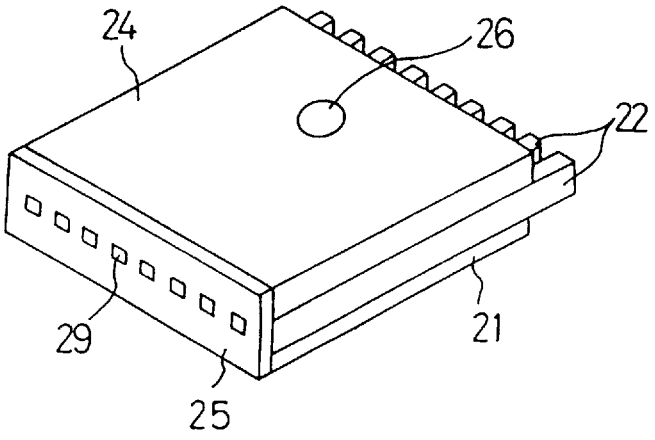
Fig.13 RELATED ART
FIG. 13 is a perspective view of the completed conventional ink ejecting print head.
Figure 14A:
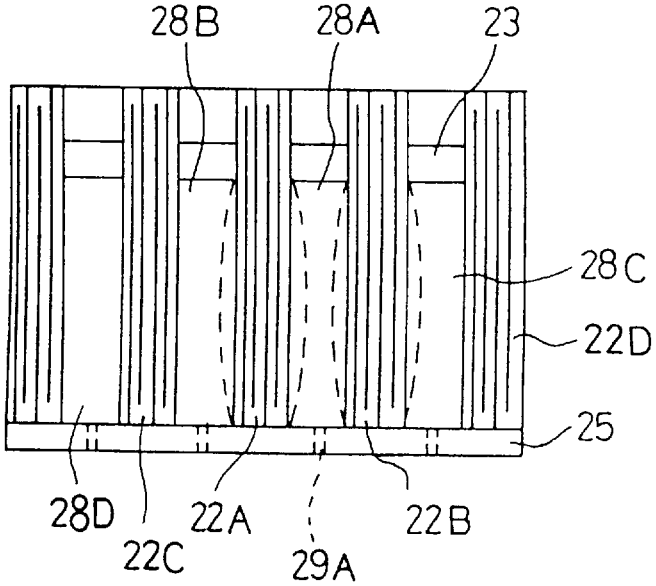
Fig.14A RELATED ART
FIGS. 14A and 14B illustrate an operation of the conventional ink ejecting print head.
Figure 14B:
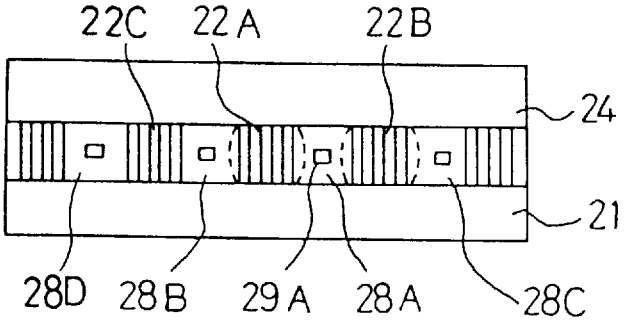
Fig.14B RELATED ART

Therefore, an electric field is formed in the areas 40A of the shared partition walls 40 which are adjacent to the ink channel 37A, so that the areas 40A of the shared partition walls 40 are deformed, as indicated by the broken lines in FIG. 9. The deformation causes the volume of the ink channel 37A to decrease. Thus, pressure is produced in the ink channel 37A, so that the ink is ejected from the nozzle 3A connected to the ink channel 37A. At this time, no electric field occurs in the areas 40B or 40C of the shared partition walls 40 which are shared by the ink channels 37A and 37B, or the ink channels 37A and 37C, respectively. Therefore, the ink channels 37B and 37C adjacent to the ink channel 37A suffer no ill effects, unlike the conventional ink ejection print head shown in FIG. 12.

As described above, according to this first preferred embodiment of the ink ejecting print head 1, the conductor layers 12B are provided in the shared partition walls 40 to deform only the side of the shared partition wall 40 forming the ink ejection channel from which the ink is to be ejected. Thus, the deformation of the ink ejection channel 37A has no effect on the ink non-ejection channels 37B and 37C which are adjacent to the ink ejection channel 37A. Accordingly, ink can be simultaneously ejected from the adjacent ones of the ink channels 37. Therefore, high-speed printing can be performed. In addition, no dummy channel need be provided between the ink channels, so that the integration degree, or density, of the nozzles can be improved over the prior art.

In the above-outlined first preferred embodiment, the voltage is applied to the driving electrode 13A, which is electrically connected by a conductive layer 12A to the conductive thin film 14 in the ink channel 37A from which the ink is to be ejected. The driving electrodes 13A connected by other conductive layers 12A to the conductive thin films 14 in the other ink channels 37 and the driving electrodes 13B connected to the conductor layers 12B in the shared partition walls 40 are grounded.

However, in a variation of this first preferred embodiment, the driving electrode 13A, which is electrically connected to the conductive thin film 14 in the ink channels 37 from which the ink is to be ejected, is grounded. Then, the driving electrodes 13A connected to the conductive thin films 14 in the other ink channels 37 are set to a high-impedance state. The voltage is thus applied to the driving electrodes 13B connected to the conductor layer 12B in the shared partition walls 40 adjacent to the ink channel 37A.

Figure 10:
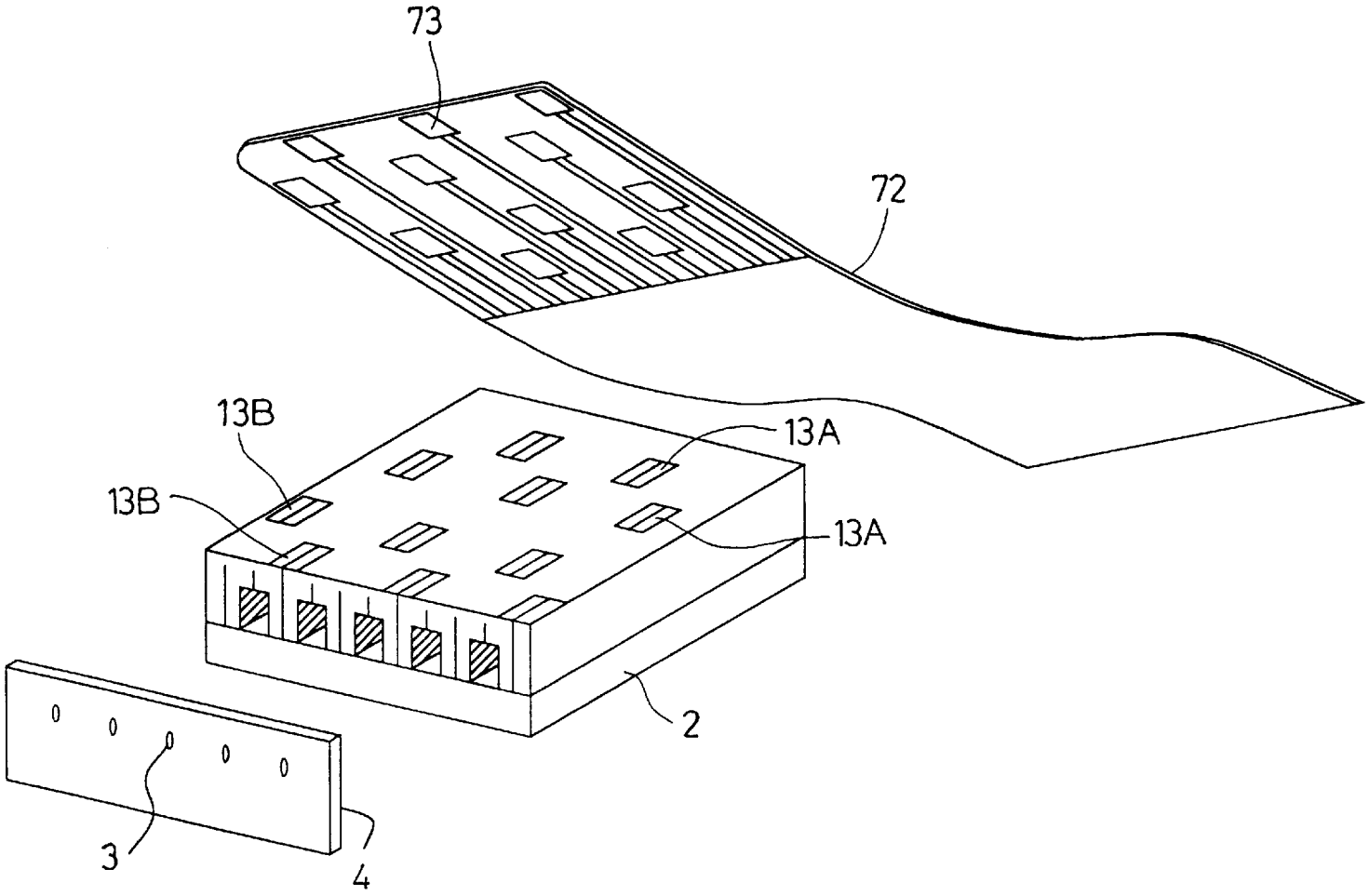
FIG. 10 shows a second preferred embodiment of the ink ejecting print head of this invention.

Furthermore, in the above-outlined first preferred embodiment, the driving electrodes 13A and 13B are each positioned at opposite ends of the upper surface of the actuator 6, as shown in FIG. 2. However, in a second preferred embodiment, the driving electrodes 13 may be arranged on the upper surface of the actuator 6 so that neighboring driving electrodes 13A or 13B are not adjacent to each other. For example, the driving electrodes 13A and 13B can be positioned in a zigzag pattern, as shown in FIG. 10. In this case, the conductor layers 31A and 31B must be modified. In addition, the contact electrodes 73 of the flexible board 72 are also positioned in the zig-zag pattern to face the driving electrodes 13. With this arrangement, the contact electrodes 73 and the driving electrodes 13 can be easily connected to each other.

Figure 11:
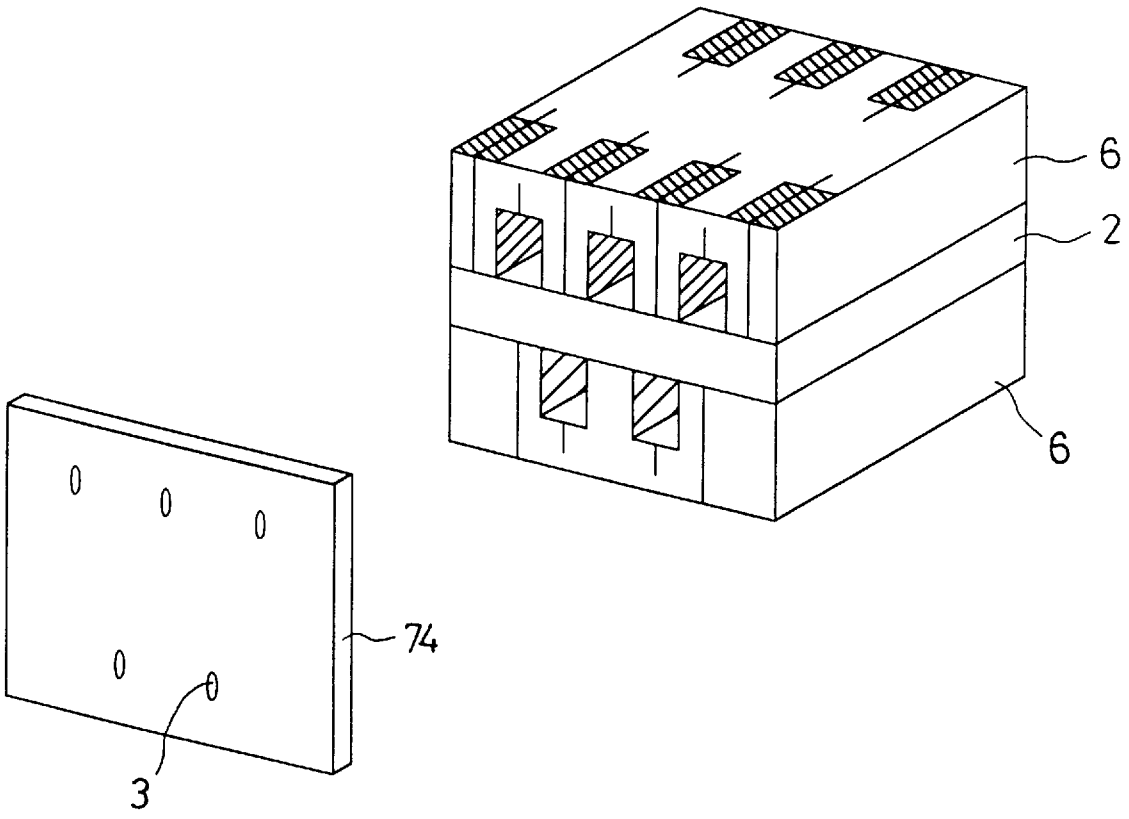
FIG. 11 show a third preferred embodiment of the ink ejecting print head of this invention.

Additionally, in the above-outlined first preferred embodiment, the nozzles 3 are arranged in a row. However, in a third preferred embodiment, two arrays of a plurality of the nozzles 3 may be provided. For example, as shown in FIG. 11, two actuator bodies 6 and a cover plate 2 are adhesively attached to each other, so that the cover plate 2 is sandwiched between the two actuator bodies 6. The grooves 5 of the respective actuator bodies 6 are positionally displaced from one another so that an ink channel 37 of one actuator body 6 faces a partition wall 40 of the other actuator body 6. A nozzle plate 73 having two arrays of nozzles 3 is adhesively attached to the front faces of the actuator bodies 6 and the cover plate 2. In this case, different color ink may be supplied to each of the upper and lower arrays of nozzles. Of course, the same color ink may be supplied to the two arrays of nozzles.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An actuator body of an ink ejecting printing apparatus having a plurality of partition walls and a plurality of grooves between the plurality of partition walls, the actuator body comprising:

a plurality of piezoelectric members and a plurality of conductor layers alternatingly laminated together, the plurality of conductor layers including a first subset of conductor layers and a second subset of conductor layers;

each conductor layer exposed at a top surface of the actuator body;

a plurality of driving electrodes formed on the top surface of the actuator body, each driving electrode electrically connected to one of the conductor layers;

each conductor layer of the first subset of conductor layers extending into a corresponding one of the plurality of partition walls;

each conductor layer of the second subset of conductor layers exposed at a bottom surface of a corresponding one of the plurality of grooves; and a conductive thin film provided on the bottom and side surfaces of each groove and connected to the corresponding conductor layer of the second subset of the conductor layers.

2. The actuator body of claim 1, wherein each conductor layer of the first subset of the conductor layers alternates with each conductor layer of the second subset of the conductor layers in the actuator body in a direction perpendicular to a lamination direction of the plurality of conductor layers.

3. The actuator body of claim 2, wherein each of the plurality of piezoelectric members is polarized in a direction extending parallel to the lamination direction of the plurality of conductor layers.

4. The actuator body of claim 3, wherein each partition wall is formed by one conductor layer of the first subset of the conductor layers, a portion of a first one of the plurality of the piezoelectric members, and a portion of a second one of the plurality of the piezoelectric members, wherein the first one of the plurality of the piezoelectric members is polarized in a first direction and the second one of the plurality of the piezoelectric members is polarized in a second direction which is opposite to the first direction.

5. The actuator body of claim 3, wherein, when a driving voltage is applied to one conductor layer of the second subset of the conductor layers, the piezoelectric members adjacent to the driven conductor layer to change a volume of the groove corresponding to the driven conductor layer.

6. The actuator body of claim 5, wherein, when the driving voltage is applied to the driven conductor layer, the piezoelectric members adjacent to grooves which are adjacent to the groove corresponding to the driven conductor layer do not change a volume of the adjacent grooves.

7. The actuator body of claim 3, wherein the polarization direction and an electric field direction of an electric field generated in the plurality of piezoelectric members are parallel.

8. An ink ejecting print head of an ink ejecting printing apparatus, comprising:

an actuator body having a plurality of grooves and a plurality of partition walls;

a cover plate attached to the actuator body to cover the plurality of grooves;

a nozzle plate having a plurality of nozzles and attached to a front of the actuator body and the cover plate; and a manifold connected to the actuator body;

wherein the actuator body includes a plurality of piezoelectric members and a plurality of conductor layers alternatingly laminated together, the plurality of conductor layers including a first subset of conductor layers and a second subject of conductor layers, each conductor layer exposed at a top surface of the actuator body, a plurality of driving electrodes formed on the top surface of the actuator body, each driving electrode electrically connected to one of the conductor layers, each conductor layer of the first subset of conductor layers extending into a corresponding one of the plurality of partition walls, each conductor layer of the second subset of conductor layers exposed at a bottom surface of a corresponding one of the plurality of grooves, and a conductive thin film provided on the bottom and side surfaces of each groove and connected to the corresponding conductor layer of the second subset of the conductor layers.

9. The ink ejecting print head of claim 8, wherein each conductor layer of the first subset of the conductor layers alternates with each conductor layer of the second subset of the conductor layers in the actuator body in a direction perpendicular to a lamination direction of the plurality of conductor layers.

10. The ink ejecting print head of claim 9, wherein each of the plurality of piezoelectric members is polarized in a direction extending parallel to the lamination direction of the plurality of conductor layers.

11. The ink ejecting print head of claim 10, wherein each partition wall is formed by one conductor layer of the first subset of the conductor layers, a portion of a first one of the plurality of the piezoelectric member, and a portion of a second one of the plurality of the piezoelectric members, wherein the first one of the plurality of the piezoelectric members is polarized in a first direction and the second one of the plurality of the piezoelectric members is polarized in a second direction which is opposite to the first direction.

12. The ink ejecting print head of claim 10, wherein the polarization direction of the plurality of piezoelectric members is parallel to an electric field direction of an electric field generated in the plurality of piezoelectric members.

13. The ink ejecting print head of claim 10, wherein, when a driving voltage is applied to one of the second subset of the conductor layers, the piezoelectric members adjacent to the driven conductor layer changes a volume of the groove corresponding to the driven conductor layer.

14. The ink ejecting print head of claim 13, wherein, when the driving voltage is applied to the driven conductor layer, the piezoelectric members adjacent to grooves which are adjacent to the groove corresponding to the driven conductor layer do not change a volume of the adjacent grooves.

15. The ink ejecting print head of claim 10, wherein each partition wall is formed by one conductor layer of the first subset of the conductor layers, a portion of a first one of the plurality of the piezoelectric members, and a portion of a second one of the plurality of the piezoelectric members, wherein the first one of the plurality of the piezoelectric members is polarized in a direction extending perpendicularly from the conductor layer.

16. An actuator body of an ink ejecting printing apparatus, comprising:

a plurality of piezoelectric members and a plurality of conductive layers alternatingly laminated with each other, each conductive layer exposed at a top surface of the actuator body;

a plurality of grooves, each groove formed in an adjacent pair of the plurality of piezoelectric members;

a plurality of partition walls, each partition wall formed between an adjacent pair of the plurality of grooves, formed from the plurality of piezoelectric members, and having one of the plurality of conductive layers provided within the partition wall; and a conductive film provided on a bottom surface and side surfaces of each of the plurality of grooves;

wherein, when a driving voltage is applied to the conductive film formed on the bottom and side surfaces of a driven groove, the pair of adjacent piezoelectric members adjacent to the driven groove changes a volume of the driven groove, and undriven piezoelectric members adjacent to the pair of adjacent piezoelectric members do not change a volume of grooves adjacent to the driven groove.

17. The ink ejecting print head of claim 16, wherein the polarization direction of the plurality of piezoelectric members is parallel to an electric field direction of an electric field generated in the plurality of piezoelectric members.

18. The actuator body of claim 1, wherein, when a driving voltage is applied to the conductive this film formed on the bottom and side surfaces of a driven groove, the pair of adjacent piezoelectric members adjacent to the driven groove changes a volume of the driven groove, and undriven piezoelectric members adjacent to the pair of adjacent piezoelectric members do not change a volume of grooves adjacent to the driven groove.

19. The actuator body of claim 8, wherein, when a driving voltage is applied to the conductive this film formed on the bottom and side surfaces of a driven groove, the pair of adjacent piezoelectric members adjacent to the driven groove changes a volume of the driven groove, and undriven piezoelectric members adjacent to the pair of adjacent piezoelectric members do not change a volume of grooves adjacent to the driven groove.

* * * * *